United States Patent [19]

Ory et al.

[11] Patent Number: 4,624,117

[45] Date of Patent: Nov. 25, 1986

[54] REMOVABLE SHIPPING RESTRAINT SYSTEM FOR APPLIANCES

[75] Inventors: William F. Ory, Coloma Township, Berrien County; Paul R. Staun; Robert M. Weir, both of St Joseph Township, Berrien County, all of Mich.

[73] Assignee: Whirlpool Corporation, Benton Harbor, Mich.

[21] Appl. No.: 698,541

[22] Filed: Feb. 5, 1985

[51] Int. Cl.[4] ..... D06F 39/00

[52] U.S. Cl. ..... 68/3 R; 206/320; 206/583; 248/603

[58] Field of Search ..... 68/3 R; 248/561, 603, 248/618; 206/320, 583; 411/513, 514

[56] References Cited

U.S. PATENT DOCUMENTS

| | | | |
|---|---|---|---|
| 2,300,231 | 10/1942 | Landgraf | 68/3 R |
| 3,195,393 | 7/1965 | Vozumi | 411/513 |
| 3,249,215 | 5/1966 | Kelly | 206/320 |
| 3,335,849 | 8/1967 | Collin | 206/320 |
| 3,481,161 | 12/1969 | Waseman | 68/3 R |
| 3,611,756 | 10/1971 | Brucken | 68/3 R |
| 3,620,365 | 11/1971 | Elwell . | |
| 3,861,525 | 1/1975 | Collin | 206/320 |
| 3,912,207 | 10/1975 | Gaver | 248/561 |
| 4,174,622 | 11/1979 | Bunnell et al. | 248/603 |
| 4,298,299 | 11/1981 | Quarles | 411/514 |
| 4,366,902 | 1/1983 | Fanson et al. | 206/320 |

*Primary Examiner*—Joseph Man-Fu Moy
*Assistant Examiner*—David T. Fidei
*Attorney, Agent, or Firm*—Hill, Van Santen, Steadman & Simpson

[57] ABSTRACT

A shipping restraint system for an appliance having movable suspension components is provided which includes a plurality of locking pins engagable in apertures in the components to prevent their movement during shipping. The locking pins are held in place by cotter pins which are attached to a cord directed to the exterior of the appliance. Removal of the cotter pins will cause the locking pins to fall under gravity bias from the apertures into receiving cups thereby unlocking the movable components.

16 Claims, 7 Drawing Figures

FIG. 1
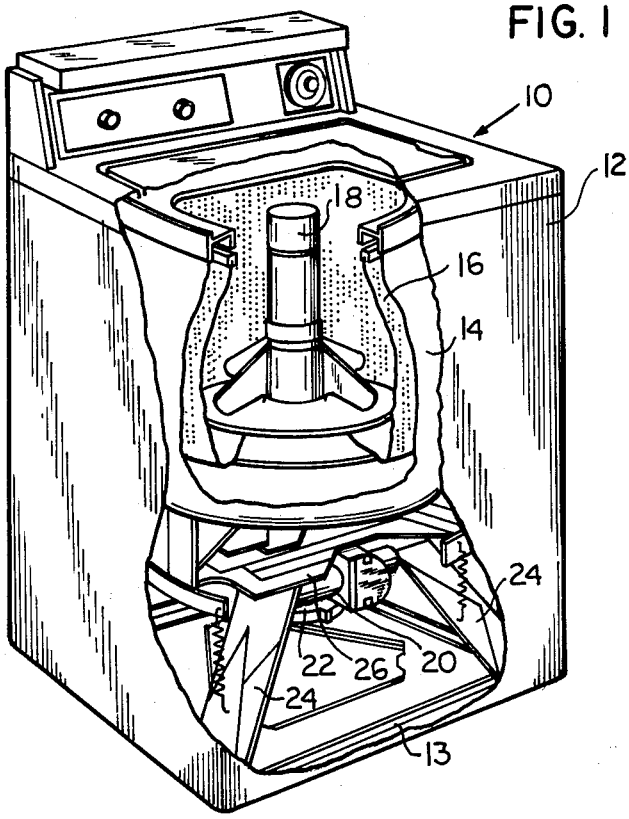
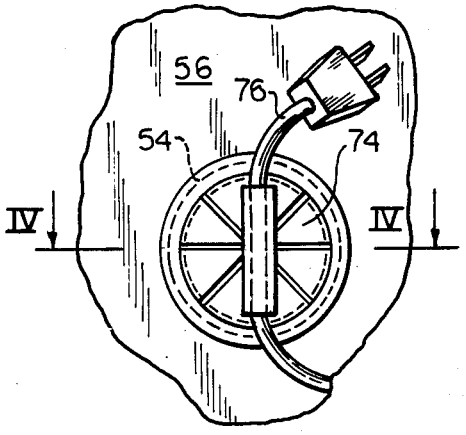
FIG. 3
FIG. 2
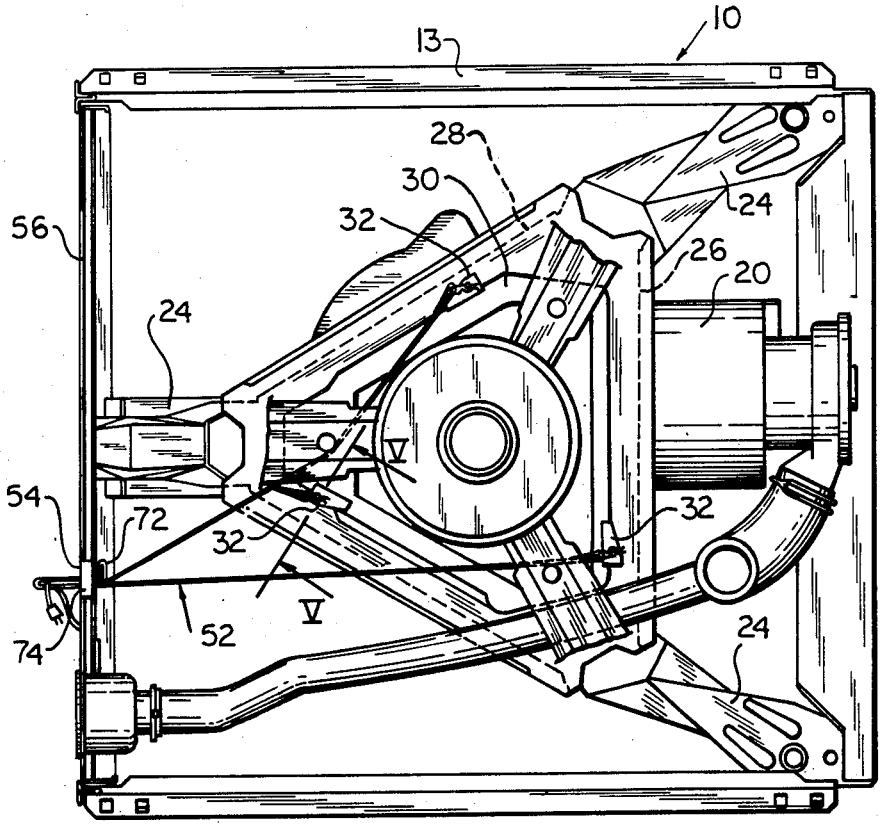

REMOVABLE SHIPPING RESTRAINT SYSTEM FOR APPLIANCES

BACKGROUND OF THE INVENTION

1. Field of the Invention

The present invention relates to a shipping restraint system for appliances and, more particularly, to a removable pin locking system for restraining movement of movable portions of an appliance during shipping.

2. Description of the Prior Art

In appliances having movable portions, such as a basket and tub assembly of an automatic washer, it is necessary to restrain the movable portions against vertical and horizontal movement during shipping. If sufficient shipping restraints are not employed, it is possible for the various portions to move relative to one another beyond their intended limits thus causing damage to the appliance. Specifically, in an automatic washer it is possible for the tub assembly to be shifted laterally against the cabinet, resulting in permanent deformation of the cabinet or damage to the tub assembly, particularly if portions of the assembly are fabricated of a plastic material.

Several different types of shipping restraint systems are proposed in the prior art. U.S. Pat. No. 3,249,215 discloses a ring-like structure for use in restraining movement of a washing machine tub and agitator in which the ring member serves as a brace between the top cabinet opening and the top of the tub and also against the agitator, to prevent movement therebetween. Other patents disclose packing devices or wedges to restrain movement of the agitator or basket within the washing machine cabinet. Such patents include U.S. Pat. Nos. 3,335,849; 3,620,365; 3,861,525 and 4,366,902. In addition to a packing block, U.S. Pat. No. 4,366,902 additionally discloses the use of removable braces to secure a bottom end of the drive assembly to the frame of the washer.

Although some of the prior shipping restraint devices may be effective to prevent movement of various parts during shipping, they are generally relatively expensive because of a multiplicity of parts or are cumbersome to install and remove.

SUMMARY OF THE INVENTION

The present invention is directed to a very simple and inexpensive restraint system which locks the movable portions of an automatic washer suspension system against horizontal and vertical movement, thereby eliminating the need for separate upper and lower restraint means such as disclosed in the U.S. Pat. No. 4,366,902. The present invention is particularly useful in an appliance in which the suspension system is comprised of three overlying elements or plates which are movable relative to each other and wherein one of the elements is fixed or rigid with respect to the appliance cabinet. A particularly advantageous embodiment of the invention is to utilize a plurality of vertically disposed locking pins which extend through cooperating apertures in the three suspension plates to interlock those members against vertical and horizontal movement. Cotter pins are provided for retaining the locking pins in place and a strap for effecting removal of the locking pins connects to each cotter pin and extends out through an aperture in the back of the cabinet. Pulling outwardly on the strap causes all of the cotter pins to be pulled from the locking pins, allowing the locking pins to drop into small plastic receiving cups disposed immediately below each locking pin. These cups are provided to prevent the pins from rolling around loosely within the washer and provide means for retrieving the pins if the suspension is to be again restrained for further shipment.

Thus, the present invention provides a shipping restraint which is inexpensive and very easy to assemble and remove, which operates by interlocking cooperating horizontally slidable suspension members in an automatic washer. This is done through the use of a vertically extending locking pin which is gravity biased to fall from its locking position upon release of retaining means, to thereby unlock cooperating movable members of the washer suspension system. Therefore, the washer suspension system is restrained by interlocking the middle portion of the suspension system rather than interlocking either or both of the top and bottom portions of the washer tub and drive assembly. Another advantageous feature of the invention is that the shipping restraint system can be released quickly and easily externally of the cabinet by pulling on the release cord thereby obviating the necessity of opening various portions of the cabinet.

BRIEF DESCRIPTION OF THE DRAWINGS

FIG. 1 is a perspective view of an automatic washer embodying the principles of the present invention.

FIG. 2 is a plan view of the suspension system for the washer shown in FIG. 1.

FIG. 3 is a partial rear view of the washer shown in FIG. 1.

DESCRIPTION OF THE PREFERRED EMBODIMENTS

Figure 5:
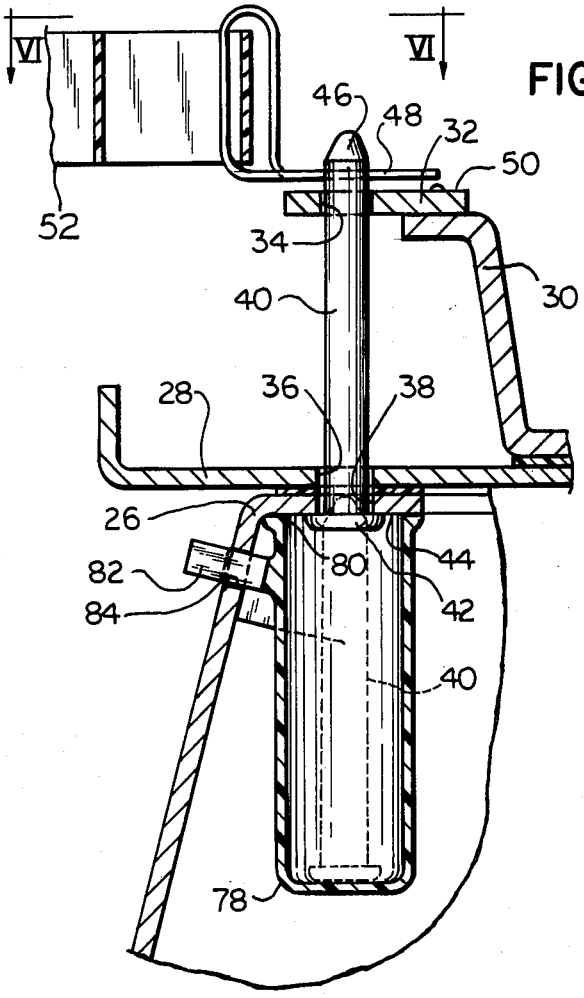
FIG. 5 is a side sectional view showing the restraining pin in place.
Figure 6:
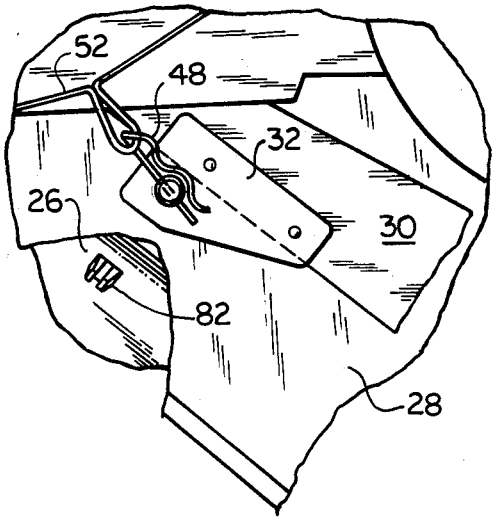
FIG. 6 is a top view showing the pin in place, taken generally along the line VI—VI of FIG. 5.

In FIG. 1 there is shown an automatic washer 10 which operates through a pre-programmed series of washing, rinsing and drying steps. The washer 10 is enclosed in an outer cabinet 12 which is attached at its base to a cabinet frame 13. The washer includes a wash tub 14, a perforate wash basket 16, and a vertical agitator 18 mounted concentrically within the wash basket 16. An electric motor 20 operates through a transmission 22 to drive the agitator and wash basket. The wash tub and drive assembly are mounted on a suspension system including legs 24. Each of the legs 24 is rigidly mounted at its lower end to a cabinet frame 13 and at its upper end to a base plate 26, as is described in detail in U.S. Pat. No. 4,174,622 assigned to Whirlpool Corporation, the assignee of the present invention. The base plate 26 is thus fixed with respect to the cabinet frame 13.

Slidingly resting on the base plate 26 is a skate plate 28 which supports a stabilizer plate 30 carrying the tub. As shown in FIG. 2, the three plates 26, 28 and 30 are arranged in an overlying manner and movement of the tub relative to the cabinet results in movement of these plates relative to one another. To prevent such movement during shipping, three brackets 32 are welded onto the stabilizing plate 30 to overlie both the skate plate 28 and the base plate 26.

As shown in FIG. 5, an aperture 34 is provided in the bracket 32, a second aligned aperture 36 is provided in the skate plate 28 and a third aligned aperture 38 is provided in the base plate 26. Although the three plates are movable relative to one another the apertures 34, 36 and 38 can be aligned to permit the insertion of a locking pin 40 up through the apertures. The pin 40 has an enlarged head 42 which abuts against a bottom surface 44 of the base plate 26 and near a top end 46 there is a through passage for receiving one leg of a cotter pin 48. The cotter pin placement is above a top surface 50 of the bracket 32 on the plate 30. Thus, the pin 40 is captured in the three plates and holds them stationary relative to each other both vertically and horizontally. As seen in FIG. 2, there are three sets of such pins and apertures thereby providing a very secure and stable restraint against relative movement of the three plates.

Figure 7:
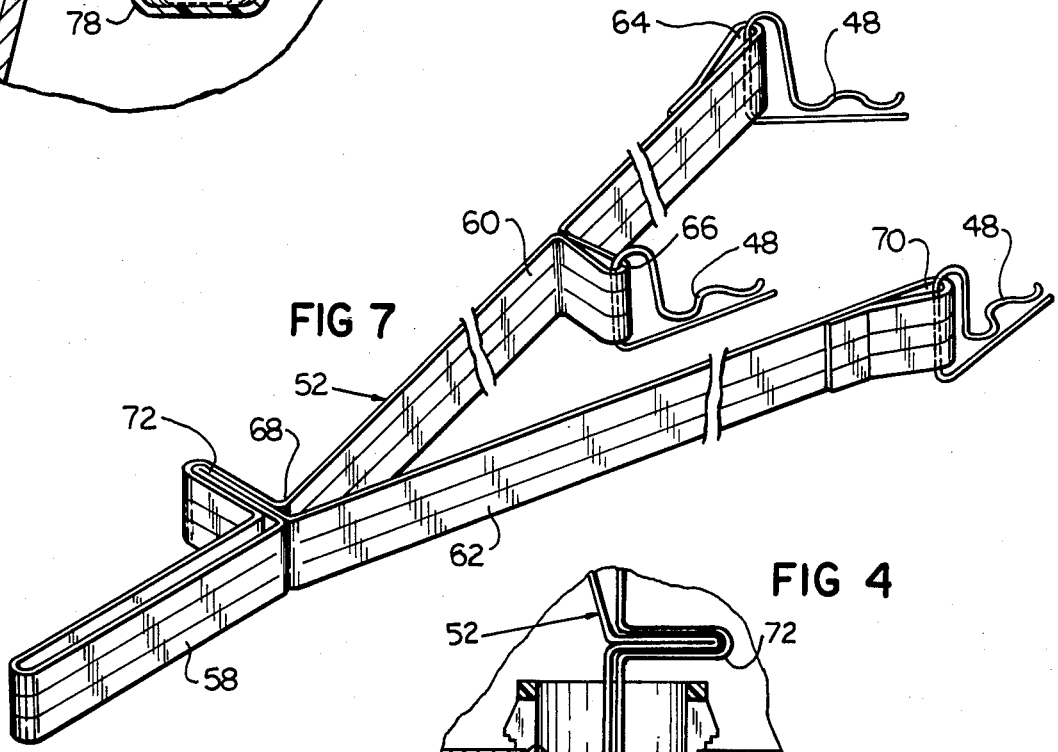
FIG. 7 is a perspective view of the retracting strap.
Figure 4:
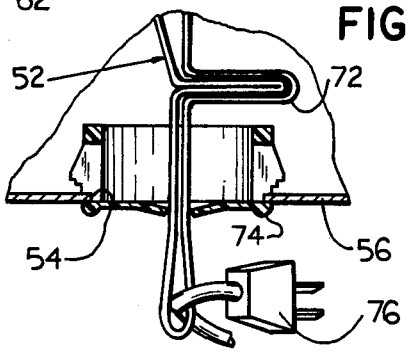
FIG. 4 is a partial sectional view taken generally along the line IV—IV of FIG. 3.

In order to effect removal of the shipping restraint system after the washer 10 has been installed at its final destination, a removal strap 52, or suitable cord or cable, is provided. The cord 52 is attached to each of the cotter pins 48 and extends through an opening 54 in a rear panel 56 of the washer 10. As shown in FIG. 7, the strap 52 is formed in a Y shape with a base leg 58 and two arms 60, 62. The first arm 60 has one cotter pin 48 attached at an end 64 thereof and a second cotter pin 48 attached at a point 66 between the end 64 and a junction 68 of the two arms 60, 62. The second arm 62 has the cotter pin 48 attached at a free end 70 thereof. At the junction point 68, there is a loop 72 formed in the strap.

To install the shipping restraint system, the locking pins 40 are inserted through the apertures 34, 36 and 38, the cotter pins 48 are inserted into the locking pins and the strap 52 is directed toward the rear panel 56 of the washer. The free leg end 58 of the strap is passed through the opening 54 to be exposed on the exterior of the washer cabinet.

To prevent the assembly person from accidentally pulling one or more of the cotter pins 48 out of the restraining pins 40, there is provided a slitted plug 74 which fits into the opening 54 in the rear panel 56 and is held there. When the assembly person pulls the free leg 58 of strap 52 through the plug 74, the loop 72 will engage the plug 74 and offer a detectable resistance. At this point, the installer will realize that the cord 52 is pulled a sufficient distance through the plug and will stop pulling. To prevent the cord 52 from falling back into the interior of the cabient, the leg end 58 is formed as an open loop and a power cord and plug 76 for the machine can be passed through the open loop thus capturing the leg end 58 on the outside of the machine cabinet. An additional advantage of using the power cord 76 to retain the strap 52 is that the user at the ultimate location will be required to pull on the power cord 76 in order to energize the machine and will thus be alerted to the strap 52 and will be positively reminded to pull the strap out of the cabinet.

As the strap 52 is pulled out of the cabinet, the cotter pins 48 are pulled out of the locking pins 40 and the pins 40 then fall downwardly under the influence of gravity to disengage from the apertures in the plates. To prevent the pins 40 from falling into the bottom of the cabinet and rolling around or from becoming engaged in other portions of the mechanism, there is provided below each pin 40 a cup 78 which has an open top end 80 to abut against the bottom surface 44 of the base plate 26. A tab 82 projects outwardly from the side of the cup 78 and extends through and is captured in an aperture 84 in the base plate 26. The cup 78 is thus removably retained adjacent to the base plate 26 and will hold the pin 40 after it has been released. If there is ever a need to reship the washer and to provide a shipping restraint, the pins 40 will be available for reuse. The tab 82 can be disengaged from the base plate 26 to provided access to the pins 40 and then the cup 78 can be reattached to the base plate 26 for reuse.

Thus, there is disclosed a removable shipping restraint system which interlocks cooperating horizontally slidable suspension members in an automatic washer. The vertically extending locking pin 40 is gravity biased to fall from its locking position upon release of the restraining means, to thereby unlock the movable members of the washer suspension system. In this manner, the "middle portion" of the washer suspension system is interlocked rather than interlocking either or both of the top and bottom portions of the washer tub and drive assembly. The restraint system has an externally operable release means and does not require opening portions of the cabinet or tilting the cabinet to obtain access to the release means.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

Having described the invention, the embodiments of the invention in which an exclusive property or privilege is claimed are defined as follows:

1. A shipping restraint system for an appliance having a cabinet with vertical sidewalls, a horizontal bottom wall for resting on a floor and a plurality of suspension components including overlying plate members which are movable relative to one another within said cabinet, comprising:

restraining means for interlocking said components in a fixed relationship; and, means for selectively releasing said restraining means from the exterior of said cabinet comprising a cable connected to said restraining means for selectively disengaging said restraining means from said components;

said cable including a free end which extends outward through an aperture in said cabinet.

2. The shipping restraint system of claim 1 wherein said restraining means comprises one or more locking pins engagable with said components and being connected to said cable extending to the exterior of said cabinet such that exertion of a force on said cable will result in disengagement of said pins from said components.

3. A shipping restraint system for an appliance having a plurality of overlying plate components interior of a cabinet which are movable relative to one another and arranged in a generally parallel adjacent manner, comprising:

means defining a coaxial aperture in each of said components;

a locking member extendable through each of said apertures in said components;

retaining means to hold said locking member in said apertures; and, means for selectively effecting the withdrawal of said locking member from said apertures comprising a strap member connected to each of said retaining means for selectively disengaging said retaining means from said locking pins thereby effecting the release of said locking members;

said strap member including a free end which extends outward through an aperture in said cabinet.

4. A shipping restraint system for an appliance having a plurality of suspension components interior of a cabinet comprising a base plate, a skate plate and a stabilizer plate which are movable relative to one another and arranged in an overlying manner, comprising:

at least one set of vertically aligned apertures in said components;

a locking pin extendable through said set of aligned apertures in said components;

retaining means to hold said pin in said apertures; and, means for selectively effecting the release of said pin comprising a strap member connected to each of said retaining means for selectively disengaging said retaining means from said locking pins thereby effecting the release of said locking pins;

said strap member including a free end which extends outward through an aperture in said cabinet;

whereby said pin will fall under gravity bias from said apertures to release the restraint on said components.

5. The shipping restraint system of claim 4 wherein said retaining means comprises a retaining pin engagable with said locking pin above at least one of said components to prevent said locking pin from falling through said apertures.

6. The shipping restraint system of claim 5 wherein said release means comprises a strap connected to said retaining pin to effect removal of said pin.

7. The shipping restraint system of claim 5 wherein said locking pin is insertable from below said components and have an enlarged head positionable below said components whereby said components will be restrained vertically by said head and said retaining pin as well as horizontally by said locking pin.

8. In an automatic washer having a vertical agitator concentrically mounted in a wash tub above a drive assembly and a plurality of relatively movable suspension system components interposed between said tub and said drive assembly all within a cabinet, a shipping restraint system comprising a means for interlocking against movement said relatively movable suspension components and means for disengaging said interlocking means comprising a strap member connected to said interlocking means, said strap member having a free end extending outward through an aperture in said cabinet.

9. The shipping restraint system of claim 8 wherein said interlocking means comprises at least one locking pin removably retained in an aligned set of apertures in said suspension components.

10. The shipping restraint system of claim 9 wherein a removable retaining pin is used to hold said locking pin in said apertures.

11. The shipping restraint system of claim 10 including a strap connected to said retaining pin to facilitate its removal.

12. The shipping restraint system of claim 10 wherein said locking pin falls out of said apertures under gravity bias upon removal of said retaining pin.

13. A shipping restraint system for an automatic washer having a vertical agitator concentrically mounted in a wash tub above a drive assembly and a suspension system including a fixed plate member and one or more movable plate members interposed between said tub and said drive assembly, comprising:

a plurality of sets of vertically aligned apertures in said members;

a locking pin extendable through each set of aligned apertures;

a retaining pin engagable with each locking pin to hold said locking pins in said apertures; and, a strap member connected to each of said retaining pins for selectively disengaging said retaining pins from said locking pins thereby effecting the release of said locking pins;

said strap member including a free end which extends outward through an aperture in said washer, whereby said locking pins will fall under gravity bias from said apertures to release the restraint on said members.

14. The shipping restraint system of claim 13 wherein said locking pins are insertable into said apertures from below said members and have an enlarged head engagable below a bottom one of said members and said retaining pin engages each locking pin just above a top one of said members, whereby said members are restrained vertically and horizontally.

15. A shipping restraint system for an automatic washer having a vertical agitator concentrically mounted in a wash tub above a drive assembly and a suspension system including a fixed plate member and one or more movable plate members interposed between said tub and said drive assembly, comprising:

a plurality of sets of vertically aligned apertures in said members;

a locking pin extendable through each set of aligned apertures;

a retaining pin engagable with each locking pin to hold said locking pins in said apertures;

a strap member connected to each of said retaining pins for selectively disengaging said retaining pins from said locking pins thereby effecting the release of said locking pins; and a cup secured below each of said locking pins to receive and hold said locking pins when said pins fall from said apertures;

whereby said locking pins will fall under gravity bias from said apertures to release the restraint on said members.

16. A shipping restraint system for an automatic washer having a vertical agitator concentrically mounted in a wash tub above a drive assembly and a suspension system including a fixed plate member and one or more movable plate members interposed between said tub and said drive assembly all within an outer cabinet, comprising:

a plurality of sets of vertically aligned apertures in said members;

a locking pin extendable through each said of aligned apertures;

a retaining pin engagable with each locking pin to hold said locking pins in said apertures;

a strap member connected to each of said retaining pins for selectively disengaging said retaining pins from said locking pins thereby effecting the release of said locking pins;

said strap member including a free end which extends outward through an aperture in said cabinet;

whereby said locking pins will fall under gravity bias from said apertures to release the restraint on said members.

* * * * *